US007118072B2

(12) United States Patent
Kobayashi et al.

(10) Patent No.: US 7,118,072 B2
(45) Date of Patent: Oct. 10, 2006

(54) METHOD FOR REDUCING RESISTANCE OF FLYING OBJECT USING EXPANDABLE NOSE CONE

(75) Inventors: Hiroaki Kobayashi, Tokyo (JP); Nobuhiro Tanatsugu, Tokyo (JP); Tetsuya Sato, Tokyo (JP); Motoyuki Hongo, Kanagawa (JP); Yusuke Maru, Kanagawa (JP)

(73) Assignee: Japan Aerospace Exploration Agency, Tokyo (JP)

( * ) Notice: Subject to any disclaimer, the term of this patent is extended or adjusted under 35 U.S.C. 154(b) by 0 days.

(21) Appl. No.: 11/037,125

(22) Filed: Jan. 19, 2005

(65) Prior Publication Data

US 2005/0269454 A1 Dec. 8, 2005

(30) Foreign Application Priority Data

Apr. 30, 2004 (JP) ..... 2004-136329

(51) Int. Cl.
*B64C 1/38* (2006.01)

(52) U.S. Cl. ..... 244/130

(58) Field of Classification Search ..... 244/1 N, 244/1 R, 1 A, 119, 130, 117
See application file for complete search history.

(56) References Cited

U.S. PATENT DOCUMENTS 1,065,506 A * 6/1913 Constantin ..... 244/130
3,041,992 A * 7/1962 Lee ..... 114/312
3,282,216 A 11/1966 Calfee et al.
3,425,650 A * 2/1969 Silva ..... 244/130
3,643,901 A * 2/1972 Patapis ..... 244/130
4,549,464 A 10/1985 Hawkins et al.
4,650,139 A * 3/1987 Taylor et al. ..... 244/161

(Continued)

FOREIGN PATENT DOCUMENTS

BE 486 061 12/1948
DE 3347005 7/1985

(Continued)

OTHER PUBLICATIONS

Robert L. Stallings, Jr., et al. "Experimental Cavity Pressure Distributions at Supersonic Speeds", NASA Technical Paper 2683, 1987 pp. 1-75.

(Continued)

*Primary Examiner*—Tien Dinh
(74) *Attorney, Agent, or Firm*—Westerman, Hattori, Daniels & Adrian, LLP.

(57) ABSTRACT

It is an object of the present invention to provide a flying object using a thin elongated nose cone with a small tip angle for reducing the air resistance during flying, wherein the maximum loading capacity can be increased without decreasing the volume efficiency of the flying object by limitations placed on the accommodation space, regardless of the structure thereof.

In the flying object in accordance with the present invention, which comprises a nose cone in the tip portion, the nose cone portion has a compressed structure in the axial direction during accommodation and expands on the tip side in the axial direction during flying, due to an expandable nose cone structure such that a disk with a small diameter is disposed in the forward position and the disks with a successively increasing diameter are disposed in the axial direction. After separation, the nose cone expands in the axial direction, deep cavities are formed between the disks, and a fine elongated nose cone with a small tip angle is provided, whereby the air resistance is reduced.

4 Claims, 8 Drawing Sheets

U.S. PATENT DOCUMENTS

| | | | | |
|---|---|---|---|---|
| 4,770,369 | A | 9/1988 | Flock et al. | |
| 5,463,957 | A | 11/1995 | Jensen et al. | |
| 5,464,172 | A | 11/1995 | Jensen et al. | |
| 6,698,684 | B1 * | 3/2004 | Henne et al. | 244/1 N |

FOREIGN PATENT DOCUMENTS

| | | |
|---|---|---|
| JP | 8-226798 | 9/1996 |
| JP | 2001-141399 | 5/2001 |

OTHER PUBLICATIONS

Maureen B. Tracy et al., "Cavity Unsteady-Pressure Measurements at Subsonic and Transonic Speeds", NASA Technical Paper 3669, Dec. 1997, pp. 1-72.

J. Peter Reding, et al. "Unsteady Aerodynamic Considerations in the Design of a Drag-Reduction Spike", Journal of Spacecraft and Rockets; vol. 14. No. 1, Janvier 1977, 1954, pp. 54-60, XP002327451 Easton, PA, US.

* cited by examiner

Fig.2- A
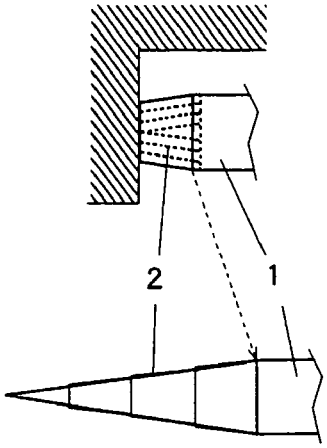
TELESCOPIC
Fig.2- B
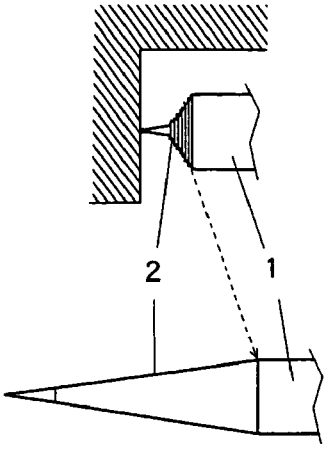
BELLOWS SYSTEM
Fig.2-C
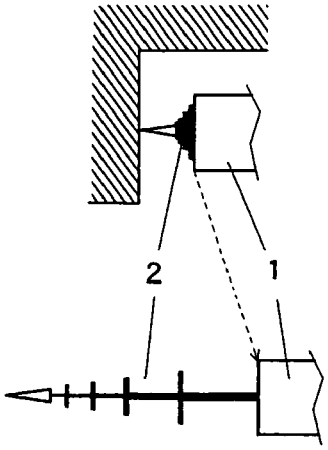
DISK SYSTEM

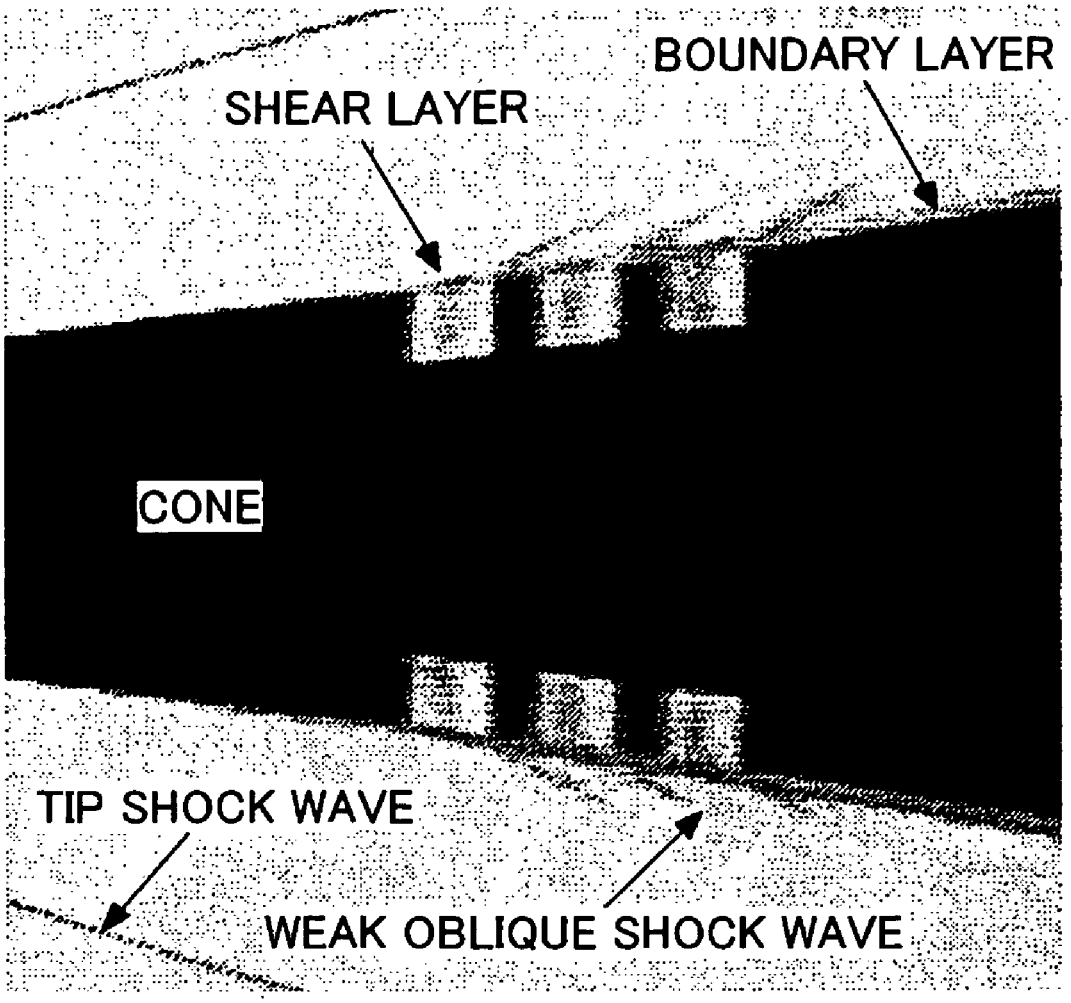
Fig.3 CONICAL CAVITY FLOW

Fig.4
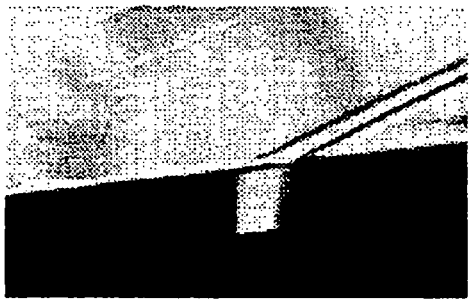
M 1
Single Cavity, L/D=1.0, D=15mm
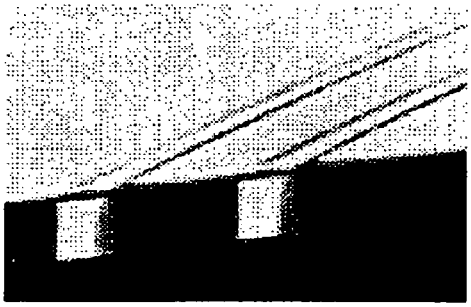
M 4
Two Cavities, L/D=1.0, D=15mm
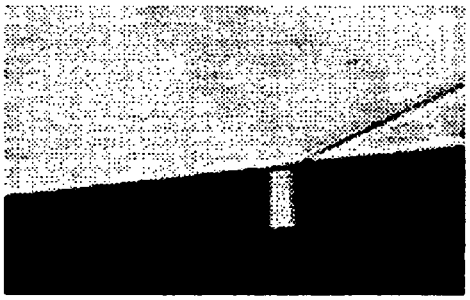
M 2
Single Cavity, L/D=0.5, D=15mm
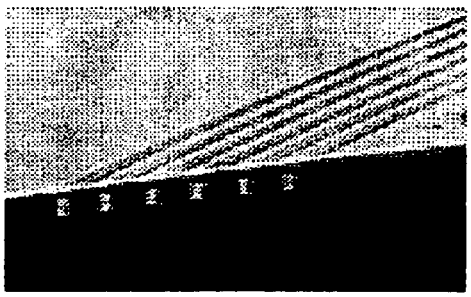
M 5
Six Cavities, L/D=1.0, D=5mm
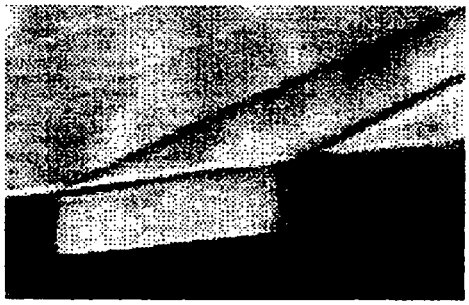
M 3
Single Cavity, L/D=3.7, D=15mm
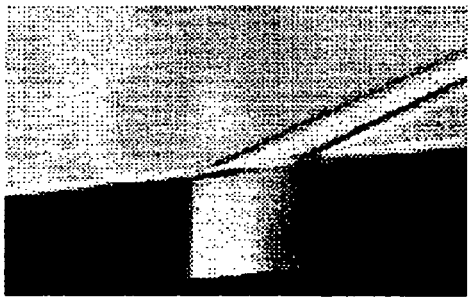
M 6
Single Cavity, L/D=1.0, D=25mm Fig.7-A
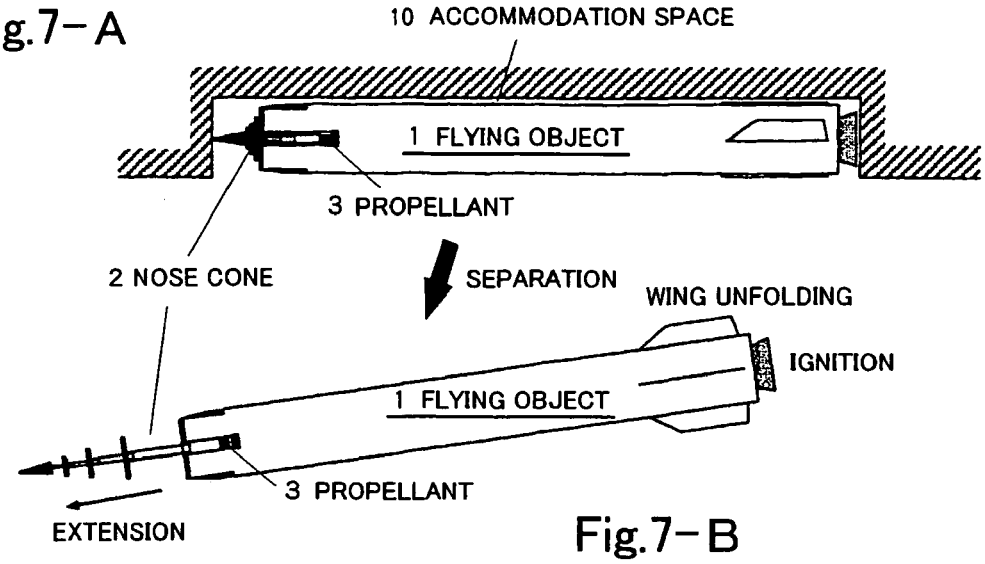
Fig.7-B
Fig.7-C
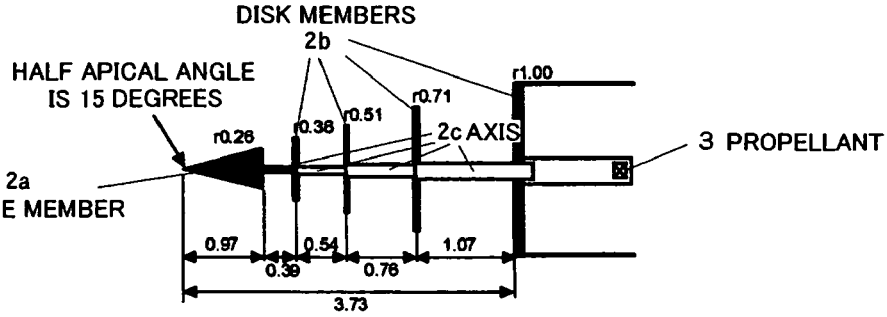

METHOD FOR REDUCING RESISTANCE OF FLYING OBJECT USING EXPANDABLE NOSE CONE

BACKGROUND OF THE INVENTION

1. Field of the Invention

The present invention relates to a method for reducing the resistance of a flying object that is carried by an aircraft or the like and is separated therefrom in the air.

2. Description of the Related Art

Forming the tip portion of a flying object as a thin elongated nose cone with a small tip angle is effective for reducing the air resistance of the flying object. However, the problem associated with thin elongated nose cones was that under conditions of limited accommodation space, the length of the main body had to be reduced which resulted in a decreased volume efficiency of the flying object and placed a limitation on the maximum load capacity thereof. Attempts to obtain a compact structure in the accommodation state by using a partially folded structure of the flying object in order to make the shape of the flying object as small as possible due to limited space for accommodating the flying object have been disclosed in Japanese Patent Application Laid-open No. 2001-141399 "Wing Unfolding Device of Flying Object" (published by Japanese Patent Office on May 25, 2001) and Japanese Patent Application Laid-open No. H8-226798 "Guided Flying Object" (Published by Japanese Patent Office on Sep. 3, 1996). The technological idea disclosed in Japanese Patent Application Laid-open No. 2001-141399 was to reduce the size and weight of a wing unfolding device for unfolding the wings in a flying object that is carried by and launched from an aircraft. For this purpose, after the flying object 2 has been launched, the aerodynamic load acting upon a parachute 7, which was released and opened rearward of the flying object 2, is transmitted to main wings 3*a* and 3*b* through hanging wires 8, thereby creating a rotation force. As a result, a lever 9 slides over the curved surface of a concave surface 8*a*, the main wings 3*a* and 3*b* rotate and unfold to the prescribed positions, and then the lever 9 fits into the concave surface 8*b*, thereby fixing the main wings 3*a* and 3*b* in their unfolded positions. Moreover, the configuration of the parachute 7 is such that after the main wings 3*a* and 3*b* have been unfolded, the parachute 7 creating aerodynamic resistance in flight is separated from the flying object 2 by the actuation of a delay cutter 11 after the prescribed time elapses. However, though the common feature of the above-described invention and the present invention is in increasing compactness in the accommodated state, it does not include the idea of reducing the air resistance of the flying object, which is essential for the present invention.

Japanese Patent Application Laid-open No. H8-226798 discloses a "guided flying object" having foldable and spreading wings developed with the aim of eliminating the unfolding mechanism or reducing the size thereof and obtaining a flying object that can be accommodated in a launcher cylinder, without placing a restriction on the size of the main body of the flying object, by using a combustion gas pressure of a rocket motor or an aerodynamic force created during flying, and also with the aim of reducing the resistance during flying and obtaining good aerodynamic characteristics. In the structure of such a guided flying object, as shown in FIG. 8, a spreading link mechanism 8 of the foldable and spreading wings is connected to a piston 7, the piston 7 is disposed inside a combustion gas inflow apparatus 10, and the wings are expanded by the pressure of the combustion gas of the rocket motor. This configuration allows the inertia force created by the control of the fuselage and an aerodynamic force created during flying to be used instead of the combustion gas pressure. The aim of this invention is to reduce the resistance during flying and to obtain good aerodynamic characteristic, but it relates to a rudder wing and does not improve the tip of the flying object.

SUMMARY OF THE INVENTION

The aim of the present invention is to provide a flying object using a thin elongated nose cone with a small tip angle for reducing the air resistance during flying, where the maximum loading capacity can be increased without decreasing the volume efficiency of the flying object by limitations placed on the accommodation space, regardless of the structure thereof.

In the flying object in accordance with the present invention, which comprises a nose cone in the tip portion, the nose cone portion has a structure that is compressed in the axial direction during accommodation and expands on the tip side in the axial direction during flying, due to an expandable nose cone structure such that a disk with a small diameter is disposed in the forward position and the disks with a successively increasing diameter are disposed in the axial direction. At the time of accommodation in a fuselage, the nose cone is compressed in the axial direction and the volume efficiency is increased. After separation, the nose cone expands in the axial direction, deep cavities are formed between the disks, a fine elongated nose cone with a small tip angle is provided, and the air resistance is reduced.

In the flying object in accordance with the present invention, which comprises a nose cone in the tip portion, a member of a conical shape is disposed in the tip of the nose cone to decrease the air resistance even more significantly.

In the flying object in accordance with the present invention, which comprises a nose cone in the tip portion, a mechanism is provided that employs, for example, a telescopic pole and enables the variation of the axial length of the nose cone.

In the flying object in accordance with the present invention, which comprises a nose cone in the tip portion, the expandable nose cone is constructed so as to have a structure such that a disk with a small diameter is disposed in the forward position and the disks with a successively increasing diameter are disposed in the axial direction. As a result, volume efficiency during flying object accommodation is improved, a fine elongated nose cone is obtained which expands in the axial direction after separation, the air resistance after flying object separation is reduced, and the increase in the continuous flying distance can be expected.

In the flying object in accordance with the present invention, which comprises a nose cone in the tip portion, a member of a conical shape is disposed in the tip of the nose cone to decrease air resistance even more significantly. Therefore, in combination with the disk group disposed on the rear side, the operation effect obtained with respect to air resistance is almost identical to that of the conventional nose cones.

In the flying object in accordance with the present invention, which comprises a nose cone in the tip portion, a mechanism is provided that employs, for example, a telescopic pole and enables the variation of the axial length of the nose cone. Therefore, switching operations of compacting the shape of the nose cone portion during accommodation and extending it in the axial direction after separation are conducted reliably and rapidly.

BRIEF DESCRIPTION OF THE DRAWINGS

FIG. 2 illustrates a specific example of the expandable nose cone in accordance with the present invention;

FIG. 3 is a Schlieren photograph of a conical cavity in an ultrasonic wind tunnel;

FIG. 4 is a Schlieren photograph of a different conical cavity model in an ultrasonic wind tunnel;

FIG. 7 illustrates an embodiment of the present invention; and

DESCRIPTION OF THE PREFERRED EMBODIMENTS

Figure 1:
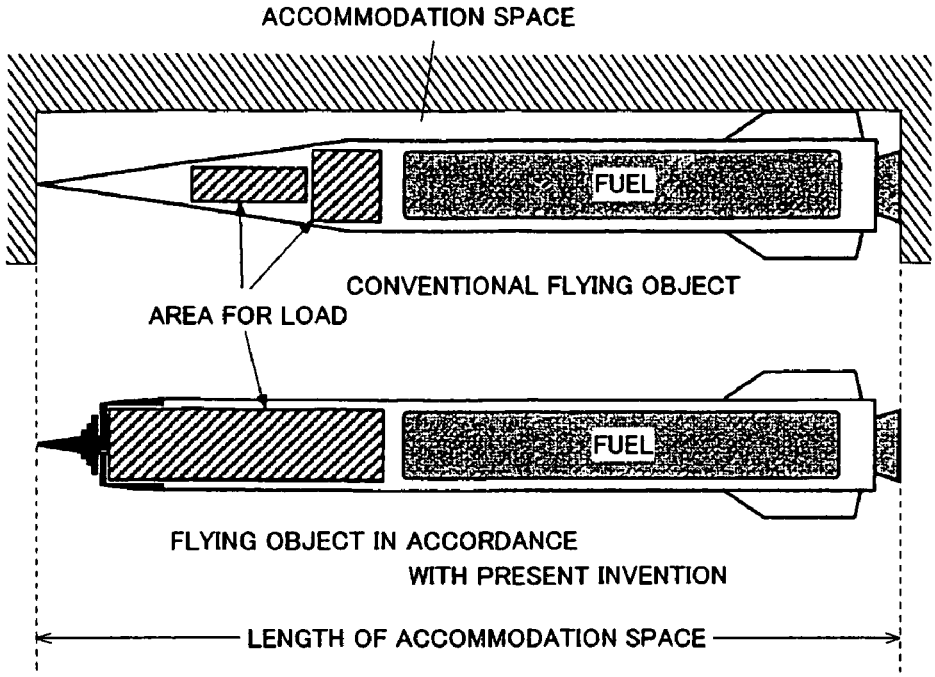
FIG. 1 is an explanatory drawing comparing the loadable regions of the conventional flying object and the flying object in accordance with the present invention.

As described hereinabove, it is an aim of the present invention to provide a flying object using a thin elongated nose cone with a small tip angle for reducing the air resistance during flying, where the maximum loading capacity can be increased without decreasing the volume efficiency of the flying object by limitations placed on the accommodation space, regardless of the structure thereof. The aforementioned shape of the thin elongated nose cone with a small tip angle is required for flying at a high speed. The idea was to create the structure of a thin elongated nose cone that can be folded or compressed to become a compact structure when the nose cone is accommodated, because the structure thereof is not required during the accommodation. When transported by an aircraft or the like, such a structure is contained in a limited space. If a narrow-tip cone nose shape is needed due to requirements during flying, then the flying object will have a structure in which, as shown in the part of FIG. 1, a portion with a large cross section is reduced in size and, after the required space is ensured for fuel, the loading space becomes very small. Accordingly, it is an aspect of the present invention that when a narrow-tip nose cone is accommodated, the shape thereof is not required to be retained and the nose cone is compression deformed, and then the narrow-tip nose cone shape is restored during the flight. In accordance with the first aspect, as shown in FIG. 2A, a telescopic system is used in which a tip nose cone 2 of a flying object 1 is in the form of round slices and folds telescopically during accommodation, whereas during flying it expands in the axial direction on the tip side, producing the shape of a thin elongated nose cone with a small tip angle. In accordance with the second aspect, as shown in FIG. 2B, a bellows system is used in which the nose cone 2 is folded as bellows during accommodation, whereas during flying it expands in the axial direction on the tip side, producing the shape of a thin elongated nose cone with a small tip angle. In accordance with the third aspect, as shown in FIG. 2C, a disk system is used such that the structure of the flying object comprises at the tip thereof a nose cone 2 with a structure in which a disk with a small diameter is disposed on the tip side and the disks with successively increasing diameter are disposed in the axial direction. With such a system, the distance between the disks is reduced during accommodation, whereas during flying, they are expanded in the axial direction toward the tip and a nose cone shape is assumed.

With the first and second aspects, the nose cone shape, which expands during flying, is not significantly different form the usual conical nose cone shape. Therefore, no aerodynamic peculiarities are observed. By contrast, with the third aspect, the shape of the expanded nose cone differs significantly from that of the usual conical nose cone. Therefore, aerodynamic peculiarities thereof have to be investigated.

With the nose cone of a disk system suggested in accordance with the present invention, which has a structure such that a disk with a small diameter is disposed on the tip side and the disks with successively increasing diameter are disposed in the axial direction, a cavity appears between a disk and a next disk disposed adjacently thereto. Accordingly, a model having cavities cut annularly on the peripheral surface of a cone was produced and aerodynamic characteristics thereof were experimentally investigated.

As for the research of flows in cavities, a large number of reports, such as Non-patent Document 1, relating to a plate-like flow have been published. Almost all those research were conducted with the object of reducing pressure vibrations and aerodynamic resistance. As shown in FIG. 7, it was reported that better results relating to properties of the flow field are obtained for a deep cavity than for a shallow cavity, where the deep cavity has a large size value of depth D with respect to the length L in the flow direction. When the cavity is deep, vortexes generated in the cavity are confined within the cavity, whereas in the case of a shallow cavity, vortexes flow out of the cavity, disturb a boundary layer and induce the generation of shock waves in the cavity. The graph shown in the lower part of the figure demonstrates that the pressure corresponding to the position in the flow direction in the cavity has larger fluctuations in a shallow cavity and those fluctuations disturb the air flow. As a result, a strong oblique shock waves are known to be generated from the cavity. However, there are no examples of research relating to a conical cavity which is attempted to be used in the present invention. Accordingly, the inventors have conducted an ultrasonic wind tunnel test of fluid characteristics of a conical cavity. The results obtained are described below.

FIG. 3 is a Schlieren photograph taken in an ultrasonic wind tunnel employing a cone mode in which a deep cavity and a shallow cavity were cut on a conical surface. The upstream side of the air flow is at the narrowing side of the cone which is shown in black. Three annular cavities cut in the conical surface were photographed as three white rectangles on the upper and lower surface of the cone. Observations conducted with this photo show that a linear pattern spreading to the downstream side is seen on both sides of the cone, this pattern representing tip shock waves generated from the cone tip. Furthermore, weak shock waves generated in the inclined direction from the rear end of the cavity and were observed, and also a boundary layer was seen in the vicinity of the conical surface downstream of the cavity.

Figure 6:
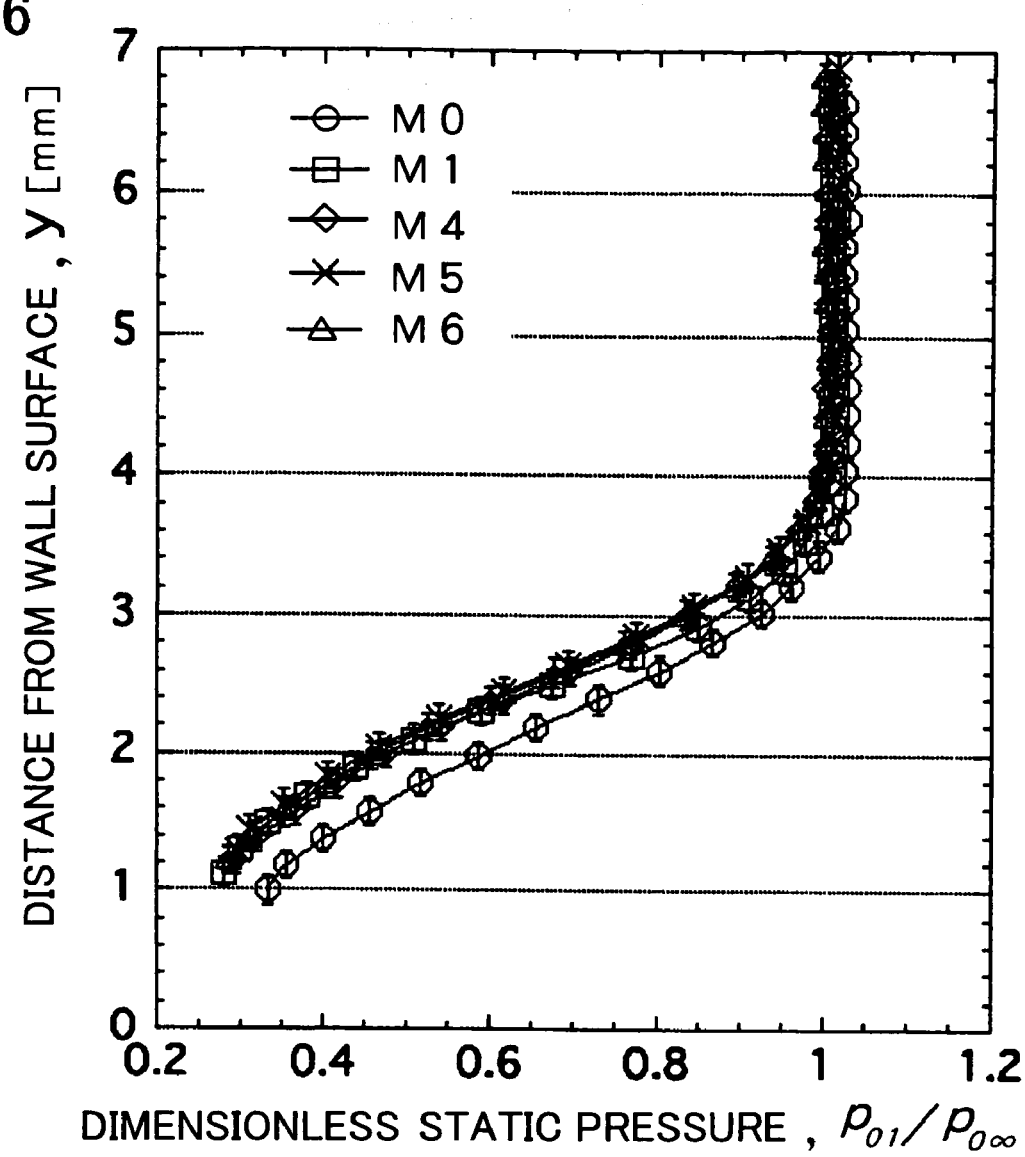
FIG. 6 is a graph comparing pressure distributions of four different conical cavity models and a conical body without a cavity in an ultrasonic wind tunnel.
Figure 8:
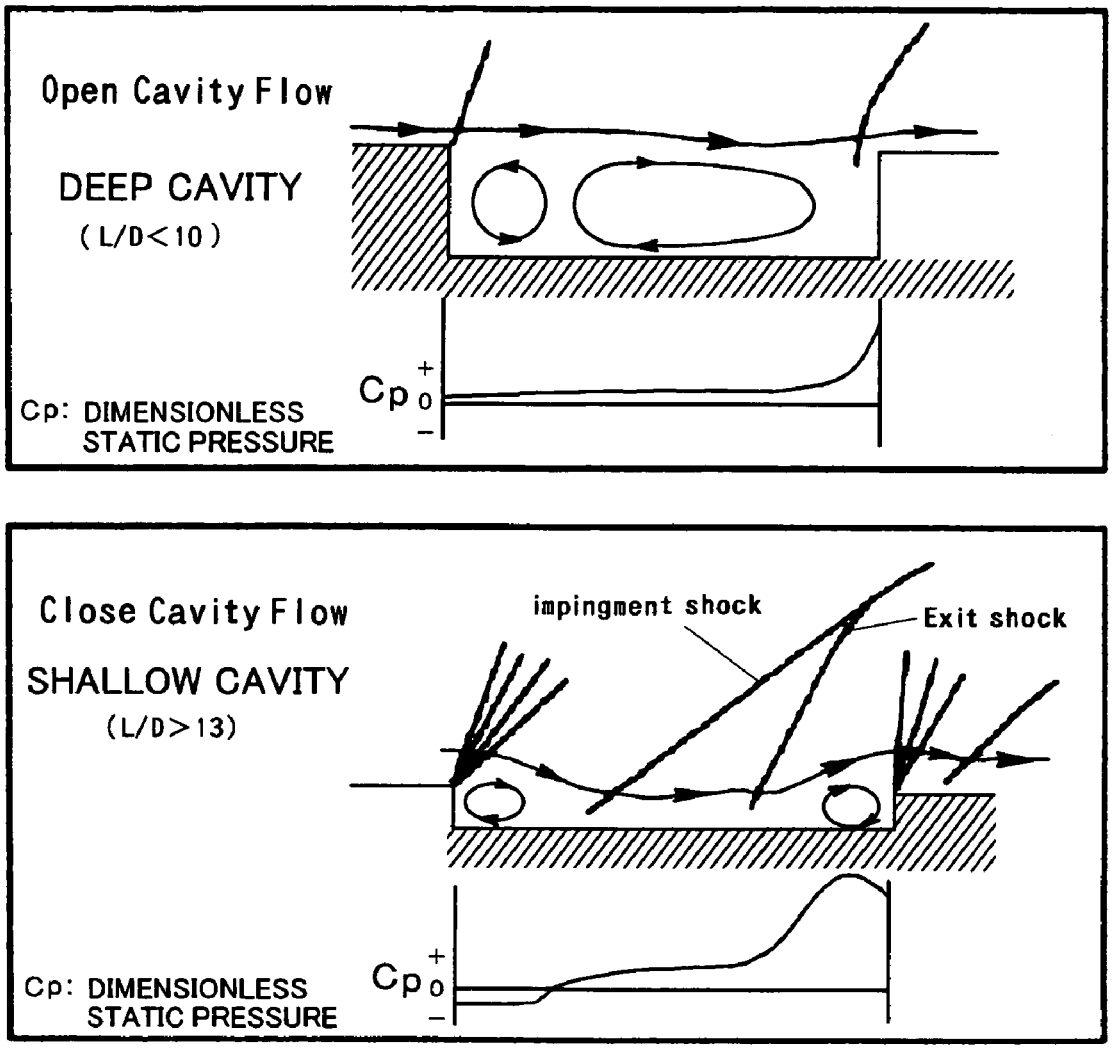
FIG. 8 illustrates the results of an aerodynamic test of the conventional well-known plate cavity.

A total of 6 models with variable number of cavities and the L/D value, that is, the ratio of the depth, D, to the length, L, of the cavity in the flow direction were prepared as the conical cavity models and a fluid test was conducted in an ultrasonic wind tunnel for the purpose of investigating the difference between those models and the cone having no cavity. The results obtained are presented in Table 1. In the table, the y value is the distance from the cone wall surface, units are mm, $p_{01}/p_{0=}$ value is a Pitot's value obtained by dividing the measured Pitot's value by the total pressure of the main flow, thereby obtaining a dimensionless value. As shown in the upper part of the table, model M0 represented a cone without a cavity that serves as a comparative example, model M1 represented a cone with one cavity with a depth of 15 mm and a L/D ratio of 1.0, model M2 represented a cone with one cavity with a depth of 15 mm and a L/D ratio of 0.5, model M3 represented a cone with one cavity with a depth of 15 mm and a L/D ratio of 3.7, model M4 represented a cone with two cavities with a depth of 15 mm and a L/D ratio of 1.0, model M5 represented a cone with six cavities with a depth of 5 mm and a L/D ratio of 1.0, and model M6 represented a cone with one cavity with a depth of 25 mm and a L/D ratio of 1.0.

plane in which the y value, which is the distance from the conical wall surface, is plotted on the ordinate and the dimensionless Pitot's value is plotted on the ordinate. This graph shows that in a zone with the distance from the wall surface of 5 mm or more, the pressure values converge to a maximum value for all the modules. In the area with a smaller distance, model M3 with a shallow cavity with a L/D value of 3.7 shows a small pressure value which is different from that for other models. However, model M2 with a deep cavity with a L/D value of 0.5, shows values almost identical to that of a cone without a cavity, and model M1 with a L/D value of 1.0 shows a certain increase in pressure value in the vicinity of the wall, but the difference is not sufficient to cause any problems. FIG. 6 is a graph in which measurement results for models M4, 5, 6, and 1 are plotted together with those for model 0. The L/D value of all the models M4, 5,

TABLE 1

| MODEL | | | | | | | | | | | | | |
|---|---|---|---|---|---|---|---|---|---|---|---|---|---|
| M0 | | M1 | | M2 | | M3 | | M4 | | M5 | | M6 | |
| CAVITY RATIO(L/D) | | | | | | | | | | | | | |
| — | | 1.0 | | 0.5 | | 3.7 | | 1.0 | | 1.0 | | 1.0 | |
| CAVITY DEPTH [mm] | | | | | | | | | | | | | |
| — | | 15 | | 15 | | 15 | | 15 | | 5 | | 25 | |
| NUMBER OF CAVITIES | | | | | | | | | | | | | |
| 0 | | 1 | | 1 | | 1 | | 2 | | 6 | | 1 | |
| y | p01/P0∞ | y | p01/P0∞ | y | P01/P0∞ | y | P01/P0∞ | y | p01/P0∞ | y | p01/p0∞ | y | P01/P0∞ |
| 1.000 | 0.333 | 1.126 | 0.280 | 1.207 | 0.331 | 1.120 | 0.240 | 1.216 | 0.295 | 1.290 | 0.297 | 1.213 | 0.286 |
| 1.182 | 0.357 | 1.296 | 0.300 | 1.382 | 0.368 | 1.285 | 0.254 | 1.384 | 0.320 | 1.443 | 0.312 | 1.374 | 0.311 |
| 1.377 | 0.400 | 1.491 | 0.333 | 1.575 | 0.422 | 1.486 | 0.278 | 1.577 | 0.366 | 1.630 | 0.354 | 1.568 | 0.352 |
| 1.572 | 0.455 | 1.684 | 0.382 | 1.778 | 0.485 | 1.680 | 0.305 | 1.778 | 0.417 | 1.836 | 0.406 | 1.773 | 0.402 |
| 1.781 | 0.517 | 1.895 | 0.438 | 1.988 | 0.553 | 1.890 | 0.338 | 1.991 | 0.475 | 2.043 | 0.467 | 1.982 | 0.458 |
| 1.983 | 0.586 | 2.099 | 0.509 | 2.192 | 0.630 | 2.097 | 0.375 | 2.192 | 0.541 | 2.248 | 0.538 | 2.185 | 0.525 |
| 2.193 | 0.655 | 2.307 | 0.589 | 2.389 | 0.702 | 2.301 | 0.419 | 2.390 | 0.617 | 2.445 | 0.616 | 2.384 | 0.601 |
| 2.392 | 0.731 | 2.504 | 0.675 | 2.594 | 0.785 | 2.498 | 0.469 | 2.593 | 0.696 | 2.645 | 0.695 | 2.586 | 0.679 |
| 2.600 | 0.804 | 2.714 | 0.768 | 2.792 | 0.850 | 2.704 | 0.524 | 2.792 | 0.769 | 2.847 | 0.775 | 2.787 | 0.760 |
| 2.802 | 0.868 | 2.914 | 0.851 | 3.015 | 0.906 | 2.915 | 0.586 | 3.014 | 0.838 | 3.067 | 0.845 | 3.005 | 0.834 |
| 3.016 | 0.925 | 3.128 | 0.910 | 3.222 | 0.950 | 3.121 | 0.643 | 3.221 | 0.897 | 3.271 | 0.908 | 3.213 | 0.893 |
| 3.215 | 0.962 | 3.328 | 0.952 | 3.417 | 0.979 | 3.324 | 0.704 | 3.412 | 0.942 | 3.465 | 0.948 | 3.409 | 0.936 |
| 3.428 | 0.993 | 3.537 | 0.978 | 3.623 | 1.001 | 3.538 | 0.762 | 3.621 | 0.969 | 3.678 | 0.979 | 3.618 | 0.970 |
| 3.636 | 1.015 | 3.747 | 0.997 | 3.834 | 1.011 | 3.737 | 0.820 | 3.834 | 0.989 | 3.883 | 0.998 | 3.823 | 0.988 |
| 3.849 | 1.024 | 3.960 | 1.007 | 4.036 | 1.016 | 3.941 | 0.863 | 4.032 | 0.996 | 4.083 | 1.007 | 4.030 | 0.999 |
| 4.038 | 1.026 | 4.155 | 1.008 | 4.240 | 1.018 | 4.147 | 0.904 | 4.234 | 1.002 | 4.288 | 1.012 | 4.231 | 1.002 |
| 4.233 | 1.027 | 4.350 | 1.011 | 4.437 | 1.017 | 4.345 | 0.935 | 4.432 | 1.003 | 4.490 | 1.012 | 4.430 | 1.003 |
| 4.435 | 1.026 | 4.553 | 1.008 | 4.638 | 1.019 | 4.552 | 0.955 | 4.631 | 1.001 | 4.694 | 1.015 | 4.631 | 1.005 |
| 4.630 | 1.028 | 4.746 | 1.011 | 4.834 | 1.020 | 4.747 | 0.971 | 4.831 | 1.004 | 4.891 | 1.016 | 4.832 | 1.005 |
| 4.835 | 1.028 | 4.947 | 1.012 | 5.035 | 1.017 | 4.951 | 0.982 | 5.033 | 1.004 | 5.091 | 1.015 | 5.035 | 1.005 |
| 5.041 | 1.024 | 5.155 | 1.010 | 5.241 | 1.017 | 5.160 | 0.991 | 5.239 | 1.002 | 5.291 | 1.013 | 5.240 | 1.002 |
| 5.236 | 1.026 | 5.350 | 1.010 | 5.439 | 1.014 | 5.354 | 0.996 | 5.437 | 1.002 | 5.493 | 1.015 | 5.440 | 1.003 |
| 5.432 | 1.023 | 5.546 | 1.007 | 5.636 | 1.015 | 5.546 | 1.000 | 5.631 | 1.002 | 5.700 | 1.014 | 5.634 | 1.001 |
| 5.624 | 1.023 | 5.736 | 1.008 | 5.824 | 1.018 | 5.742 | 1.000 | 5.818 | 1.002 | 5.887 | 1.015 | 5.826 | 1.002 |
| 5.819 | 1.028 | 5.937 | 1.008 | 6.034 | 1.017 | 5.944 | 1.002 | 6.020 | 1.003 | 6.094 | 1.016 | 6.032 | 1.003 |
| 6.025 | 1.025 | 6.144 | 1.008 | 6.235 | 1.016 | 6.147 | 1.004 | 6.219 | 1.002 | 6.291 | 1.014 | 6.232 | 1.000 |
| 6.227 | 1.022 | 6.340 | 1.006 | 6.442 | 1.013 | 6.353 | 1.004 | 6.410 | 1.001 | 6.495 | 1.013 | 6.440 | 0.999 |
| 6.433 | 1.022 | 6.546 | 1.006 | 6.636 | 1.014 | 6.550 | 1.003 | 6.601 | 1.002 | 6.690 | 1.011 | 6.634 | 0.997 |
| 6.625 | 1.022 | 6.737 | 1.005 | 6.830 | 1.016 | 6.743 | 1.002 | 6.775 | 1.004 | 6.888 | 1.013 | 6.822 | 0.998 |

FIG. 4 shows Schlieren photographs taken for the six models. The generation of oblique shock waves from the cavity was observed for all the models. However, the following difference between the cavities was found. For all the models with the exception of model M2 with a deep cavity shape with a L/D value of 0.5, the generation of shock waves was observed from the front end of the cavity to the rear end thereof, whereas in model M2, the generation of oblique shock waves was observed only from the rear side.

Figure 5:
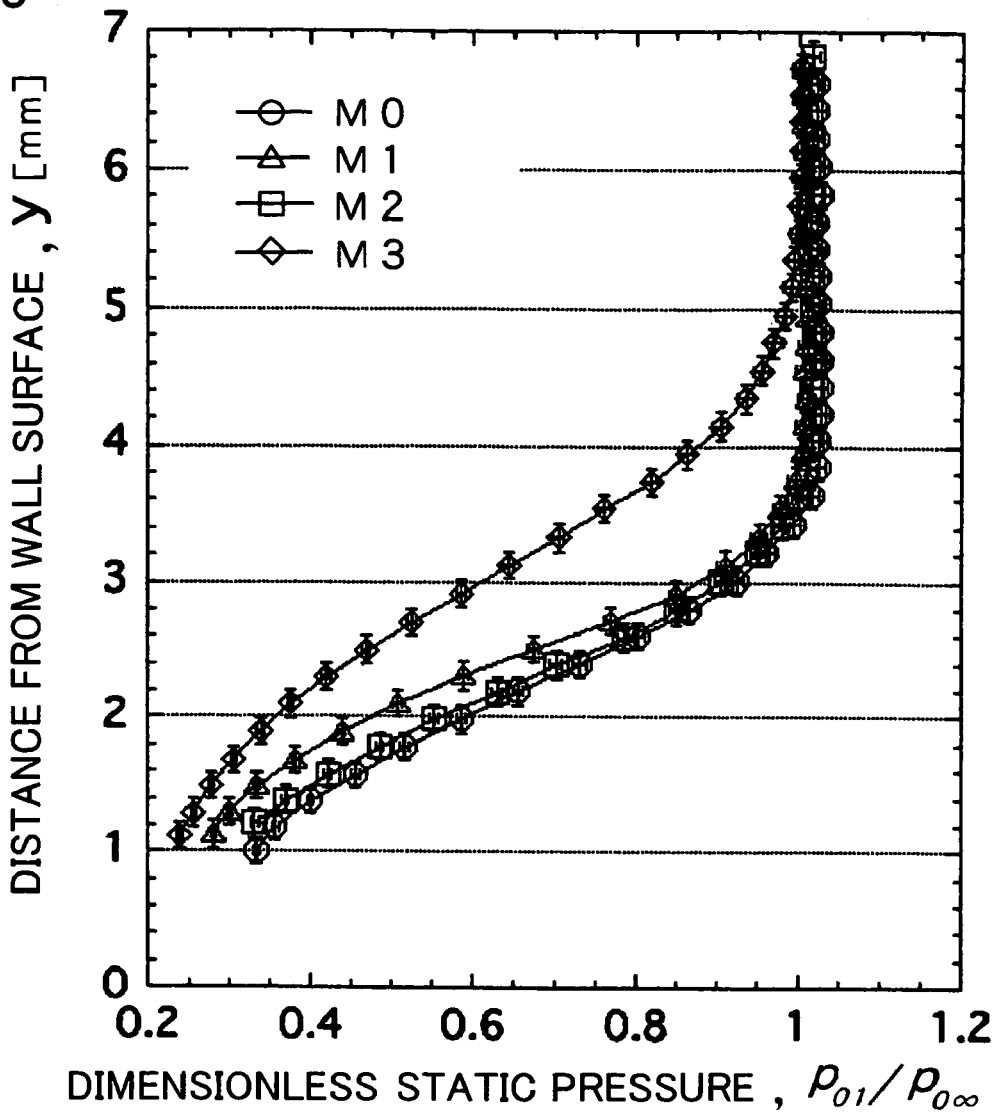
FIG. 5 is a graph comparing pressure distributions of three different conical cavity models and a conical body without a cavity in an ultrasonic wind tunnel.

FIG. 5 is a graph in which measurement results for models M1, 2, 3 are plotted together with those for model 0 on a

6 is 1.0 and is equal to that of the aforementioned model 1. As follows from the graph, those cavity models with a L/D value of 1.0 show the same values and the graphs thereof overlap. The results obtained for the model M4 with two cavities and the model M5 with six cavities are not significantly different. Therefore, those results suggest that even when the cavity is present, if the cavity is deep with a L/D value of about 1, the aerodynamic characteristic even with several cavities is not significantly different from that of the cone without a cavity. This result indicates that the disk system suggested by the present invention makes it possible to obtain an aerodynamic characteristic identical to that of the nose cone of a solid wall type if an appropriate number of disks are used and deep cavities with small L/D values are formed. Further, in the Schlieren photographs shown in FIG. 4, the generation of oblique shock waves from the cavity was observed all the models, but the pressure measurements confirmed that no significant effect was produced on the air flow, except in model M3 with a shallow cavity.

EMBODIMENT 1

One embodiment of the disk system will be described based on the above-described data with reference to FIG. 7. In this embodiment, an expandable nose cone was constructed by using three disks and a tip cone. FIG. 7A shows an accommodation state of a flying object 1, wherein part of a nose cone 2 is in a compressed state inside an accommodation space 10. FIG. 7B shows a state in which the flying object was separated from the accommodation portion and the nose cone 2 has expanded and started flying. Further, FIG. 7C is an enlarged view of the expanded nose cone portion. The three disks 2*b* and tip cone member 2*a*, which constitute the nose cone 2, are fixed to the tips of respective shafts 2*c*, the shafts 2*c* are so formed that the diameter thereof decreases toward the tip side, and the shafts 2*c* are in the form of the so-called telescopic pole in which each next member is accommodated inside the previous one. The nose cone 2 in which the tip cone member 2*a* and the disks 2*b* are in contact and stacked during accommodation is expanded by the ignition of the engine and at the same time by the ignition of propellant 3 during separation. The expanded telescopic shafts 2*c* are locked and serve as a mechanism for maintaining the expanded state. Further, the mechanism for inducing the expanding operation of the nose cone 2 may be a spring mechanism using no propellant 3.

In the expanded state, cavities are formed between the tip cone member 2*a* and the disk 2*b* and between the disk 2*b* and the next disk 2*b*. However, according to the results of the aerodynamic test of a cone cavity portion, a conical cavity flow is formed between a plurality of disks 2*b*. The basic characteristic of this flow is that the downstream boundary layer distribution practically does not change if the cavity is deep. Therefore, the design was based on the assumption that if a deep cavity is formed by using the adequate number of disks 2*b*, then the air force characteristic identical to that of the usual nose cone can be obtained. Therefore, the distance between the disks is set to increase toward the rear side, so that the spacing between the tip cone and the disk is decreased and the spacing between the disk and the next disk correspond to the diameter of the disk. In the present embodiment, when the radius of the cylindrical portion of the flying object was set to 1, the half apical angle of the tip cone member 2*a* was 15 degrees, the length size was 0.97, the radius of the rear end portion was 0.26, the radius of the three disks 2*b* was 0.36, 0.51, and 0.71 from the front one, and the respective spacing were 0.39, 0.54, 0.76, and 1.07. Therefore, in the present embodiment, the entire length of the nose cone was 3.73 and the L/D value was 1.5 when the radius of the cone portion of the flying object was set to 1.

What is claimed is:

1. A flying object, comprising:

an expandable nose cone having a variable length structure in an axial direction such that, when the nose cone is expanded on a tip side in the axial direction, a disk with a small diameter is disposed first, then disks with a successively increasing diameter are disposed in the axial direction, and deep cavities with a L/D value in the range $0.5 \leqq L/D < 3.7$ are formed between the disks, where L is the size of the space between the disks, and D is the size of the cavity depth.

2. The flying object forming a nose cone according to claim 1, wherein a cone-shaped member is disposed in the very top portion of the nose cone.

3. The flying object forming a nose cone according to claim 1, wherein the mechanism enabling the variation of the axial length of the nose cone is of a telescopic pole system.

4. The flying object forming a nose cone according to claim 2, wherein the mechanism enabling the variation of the axial length of the nose cone is of a telescopic pole system.

* * * * *